US006048054A

United States Patent [19]

Ando et al.

[11] Patent Number: 6,048,054

[45] Date of Patent: Apr. 11, 2000

[54] INK REPLENISHING APPARATUS AND INK REPLENISHING METHOD FOR INK-JET PRINTING INK CARTRIDGE

[75] Inventors: Yoichi Ando, Sagamihara; Hajime Toda, Machida; Kiyoshi Fujisawa, Yamato, all of Japan

[73] Assignee: Mitsubishi Pencil Kabushiki Kaisha, Tokyo, Japan

[21] Appl. No.: 08/898,580

[22] Filed: Jul. 22, 1997

[30] Foreign Application Priority Data

| | | | |
|---|---|---|---|
| Aug. 29, 1996 | [JP] | Japan | 8-245422 |
| Nov. 20, 1996 | [JP] | Japan | 8-323350 |
| Nov. 20, 1996 | [JP] | Japan | 8-323351 |
| Dec. 18, 1996 | [AD] | Andorra | 8-353750 |

[51] Int. Cl.[7] ..... M41J 2/175

[52] U.S. Cl. ..... 347/85

[58] Field of Search ..... 347/7, 84, 85, 347/86, 87; 141/329

[56] References Cited

U.S. PATENT DOCUMENTS

| | | | |
|---|---|---|---|
| 2,620,499 | 12/1952 | Dressel | 401/119 |
| 2,737,927 | 3/1956 | Rhoades | 401/119 |
| 4,614,163 | 9/1986 | Hetzer et al. | 118/268 |

FOREIGN PATENT DOCUMENTS

| | | |
|---|---|---|
| 586 792 | 5/1993 | European Pat. Off. . |
| WO 94/13495 | 6/1994 | WIPO . |
| WO 94/25293 | 11/1994 | WIPO . |

*Primary Examiner*—N. Le
*Assistant Examiner*—Anh T. N. Vo
*Attorney, Agent, or Firm*—Darby & Darby

[57] ABSTRACT

An ink replenishing apparatus replenishes an ink cartridge, which has an ink absorber made of a porous body or fiber bundle in an ink storage chamber that stores ink, with ink supplied from a replenishing ink cartridge through a relay core. An ink holding force d of capillary tubes of the relay core and an ink holding force D of capillary tubes of the porous body or fiber bundle satisfy the following relation d<D.

5 Claims, 11 Drawing Sheets

INK REPLENISHING APPARATUS AND INK REPLENISHING METHOD FOR INK-JET PRINTING INK CARTRIDGE

BACKGROUND OF THE INVENTION (1) Field of the Invention

The present invention relates to an ink replenishing apparatus and method for an ink-jet printing ink cartridge (to be referred to as a printing ink cartridge hereinafter), capable of quickly replenishing a printing ink cartridge, which has an ink absorber made of a porous body or fiber bundle in an ink storage chamber, with an optimum amount of ink.

(2) Description of the Prior Art

Conventionally, when replenishing a printing ink cartridge, having an ink absorber made of a porous body or fiber bundle in an ink storage chamber, with an ink, for example, the ink is directly dropped to the absorber with a dropping pipette, or the ink is injected into the absorber with a syringe.

With the conventional ink replenishing method, it is difficult to determine the optimum amount of ink to be replenished in accordance with the amount of ink remaining in the ink cartridge. When the cartridge is replenished with ink particularly excessively, the ink overflows from a portion of the ink cartridge through which the ink replenishment is performed, or the ink leaks from another opening portion (a vent hole, an ink discharge port, or the like) of the ink cartridge.

A color-printing ink cartridge usually has a plurality of ink storage chambers in units of colors, and the amount of ink consumed by printing differs from one chamber to another among different colors.

Conventionally, to replenish a color-printing ink cartridge with inks, only an ink storage chamber, the ink of which has been consumed completely, is replenished with a predetermined amount of ink with a dropping pipette or the like, and then the ink cartridge is used for printing again. However, ink is not supplied to other ink storage chambers, the ink of which has been consumed to a certain degree. Therefore, optimum amounts of ink are not constantly supplied to the respective ink storage chambers, and ink shortage often occurs in an ink color of the ink storage chamber which is not previously replenished with ink.

When replenishing with ink the ink storage chamber where ink shortage occurs, if the user tries to replenish other ink storage chambers as well with ink, it is difficult to replenish these ink storage chambers with optimum amounts of ink.

SUMMARY OF THE INVENTION

It is an object of the present invention to provide an ink replenishing apparatus and method for a printing ink cartridge, capable of quickly replenishing the printing ink cartridge, which has an ink absorber made of a porous body or fiber bundle in an ink storage chamber, with an optimum amount of ink.

According to an aspect of the present invention, there is provided an ink replenishing apparatus for an ink-jet printing ink cartridge which comprises: a replenishing ink cartridge for replenishing an ink-jet printing ink cartridge, which has an ink absorber made of a porous body or fiber bundle in an ink storage chamber that stores ink, with ink; and a relay core interposed between the printing ink cartridge and the replenishing ink cartridge to supply the ink from the replenishing ink cartridge to the printing ink cartridge, wherein an ink holding force d of capillary tubes of the relay core and an ink holding force D of capillary tubes of the porous body or fiber bundle satisfy the following relation.

$$d<D$$

Ink in the replenishing ink cartridge is sucked up by the relay core to replenish the ink absorber in the printing ink cartridge. Since the ink holding force d of the capillary tubes of the relay core is smaller than the ink holding force D of the capillary tubes of the ink absorber, an optimum amount of ink is reliably supplied from the replenishing ink cartridge to the ink absorber in the printing ink cartridge. The printing ink cartridge will not be charged with the ink in an amount exceeding the ink holding force of the ink absorber, and the ink will not overflow from the printing ink cartridge while being supplied.

If the positional relationship is maintained such that the head pressure of the ink absorbed by the ink absorber in the printing ink cartridge does not act on the ink in the replenishing ink cartridge, it will decrease the risk of charging the printing ink cartridge with the ink in an amount exceeding the ink holding force of the ink absorber.

Since the ink holding force d of the capillary tubes of the relay core is smaller than the ink holding force D of the capillary tubes of the ink absorber, ink that has been replenished in the ink absorber in the printing ink cartridge once will not flow backward through the relay core to return to the replenishing ink cartridge.

Ink replenishment by the replenishing ink cartridge according to the present invention has functions as described above. Ink replenishment of the printing ink cartridge from the replenishing ink cartridge according to the present invention is performed by the capillary action of the relay core and ink absorber and does not depend on the head pressure applied from the printing ink cartridge to the replenishing ink cartridge. When performing ink replenishment, the positional relationship between the replenishing ink cartridge and the printing ink cartridge is not particularly limited. If the relay core, an atmosphere communicating port serving as a means for adjusting the pressure in the replenishing ink cartridge, the amount of ink in the replenishing ink cartridge, or the like can be adjusted, the ink can be supplied also from above the printing ink cartridge. Hence, the present invention can cope with a variety of printing ink cartridges that are commercially available as replenishing ink cartridges.

As described previously, even the printing ink cartridge having a plurality of ink absorber storage chambers can be replenished with the optimum amounts of ink at once very easily by employing the principle of the present invention.

The relay core used in the ink replenishing apparatus according to the present invention can have a gap near it. Therefore, when the ink flows through the relay core, the ink flow will not be interfered with by small air bubbles in the relay core.

Furthermore, as the outer surface of the relay core and the inner surface of the relay core holder are not in contact with each other, the ink will not be easily influenced by the surface tension between them. Therefore, the ink flows well.

According to another aspect of the present invention, there is provided an ink replenishing apparatus for an ink-jet printing ink cartridge which comprises: a replenishing ink cartridge for replenishing an ink-jet printing ink cartridge, which has an ink absorber made of a porous body or fiber bundle in an ink storage chamber that stores ink, with ink; and a relay core interposed between the printing ink cartridge and the replenishing ink cartridge to supply the ink from the replenishing ink cartridge to the printing ink cartridge, wherein an ink holding force d1 of capillary tubes of the relay core, a holding force d2 generated between the relay core and a holding portion of the replenishing ink cartridge, and an ink holding force D of capillary tubes of the porous body or fiber bundle satisfy the following relation.

$$d1+d2<D$$

Ink in the replenishing ink cartridge is sucked up by the relay core to replenish the ink absorber in the printing ink cartridge. Since a composite force of the ink holding force d1 of the capillary tubes of the relay core and the holding force d2 generated between the relay core and the holding portion of the replenishing ink cartridge is smaller than the ink holding force D of the capillary tubes of the ink absorber, an optimum amount of ink is reliably supplied from the replenishing ink cartridge to the ink absorber in the printing ink cartridge. The printing ink cartridge will not be charged with the ink in an amount exceeding the ink holding force of the ink absorber, and the ink will not overflow from the printing ink cartridge while being supplied.

If the positional relationship is maintained such that the head pressure of the ink absorbed by the ink absorber in the printing ink cartridge does not act on the ink in the replenishing ink cartridge, it will decrease the risk of charging the printing ink cartridge with the ink in an amount exceeding the ink holding force of the ink absorber.

Since the composite force of the ink holding force d1 of the capillary tubes of the relay core and the holding force d2 generated between the relay core and the holding portion of the replenishing ink cartridge is smaller than the ink holding force D of the capillary tubes of the ink absorber, ink that has been replenished in the ink absorber in the printing ink cartridge will not flow backward through the relay core to return to the replenishing ink cartridge.

In addition, the relay core used in the ink replenishing apparatus according to the present invention can have a gap near it. Hence, when the ink flows through the relay core, the ink flow will not be interfered with by small air bubbles in the relay core.

Ink replenishment by the replenishing ink cartridge according to the present invention has functions as described above. Ink replenishment from the replenishing ink cartridge according to the present invention to the printing ink cartridge is performed by the capillary action of the relay core and ink absorber and does not depend on the head pressure applied from the printing ink cartridge to the replenishing ink cartridge. When performing ink replenishment, the positional relationship between the replenishing ink cartridge and the printing ink cartridge is not particularly limited. If the relay core, an atmosphere communicating port serving as means for adjusting the pressure in the replenishing ink cartridge, the amount of ink in the replenishing ink cartridge, or the like can be adjusted, the ink can be supplied also from above the printing ink cartridge. Hence, the present invention can cope with a variety of printing ink cartridges that are commercially available as replenishing ink cartridges. Note that if the ink is supplied to the printing ink cartridge from below, a balance required for preventing overflow of the ink can be obtained easily.

As described previously, even the printing ink cartridge having a plurality of ink absorber storage chambers can be replenished with the optimum amounts of inks at once very easily by employing the principle of the present invention.

According to still another aspect of the present invention, there is provided a method for replenishing an ink-jet printing ink cartridge with ink which comprises the step of: replenishing the ink-jet printing ink cartridge, which has an ink absorber made of a porous body or fiber bundle in an ink storage chamber that stores ink, with ink supplied from a replenishing ink cartridge through a relay core, wherein the ink storage chamber is inclined so that a head pressure acting on an opening portion of the ink-jet printing ink cartridge becomes smaller than that in a vertical state, and an ink holding force d of capillary tubes of the relay core and an ink holding force D of capillary tubes of the porous body or fiber bundle satisfy the following relation.

$$d<D$$

As means for maintaining the positional relationship such that the head pressure of the ink absorbed by the ink absorber in the printing ink cartridge does not act on the ink in the replenishing ink cartridge, the interior of the ink storage chamber is inclined from the vertical position, so that the head pressure of the ink absorbed by the ink absorber which is applied by the ink in the printing ink cartridge to the relay core can be decreased.

In addition, if the interior of the ink storage chamber is inclined to decrease the head pressure acting on the opening portion of the ink storage chamber to be smaller than in the vertical state, such that the head pressure of the ink absorbed by the ink absorber in the printing ink cartridge will not act on the ink in the replenishing ink cartridge, the head pressure of the ink absorbed by the ink absorber which is applied by the ink in the printing ink cartridge to the relay core can be decreased, and the ink supply rate can be increased accordingly by a value corresponding to the decrease in head pressure.

Further advantages and features of the invention as well as the scope, nature and utilization of the invention will become apparent to those skilled in the art from the description of the preferred embodiments of the invention set forth below.

DESCRIPTION OF THE PREFERRED EMBODIMENTS

Figure 1:
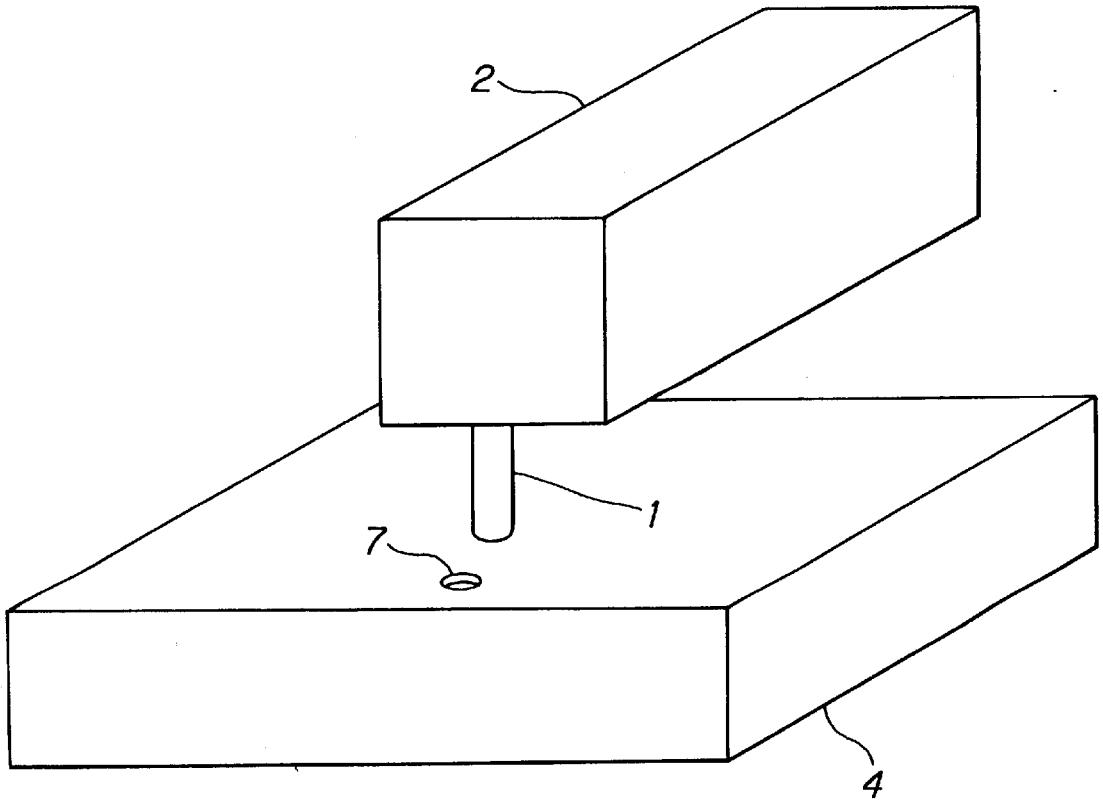
FIG. 1 is a perspective view showing an ink replenishing apparatus according to the first embodiment of the present invention, which indicates an ink replenishing state.

When replenishing an ink cartridge, which has an ink absorber made of a porous body or fiber bundle in an ink storage chamber that stores ink, with ink supplied from a replenishing ink cartridge through a relay core, an ink holding force d of the capillary tubes of the relay core and an ink holding force D of the capillary tubes of the porous body or fiber bundle is set to satisfy the following relation.

$$d<D$$

In the present invention, the relay core is inserted in the replenishing ink cartridge so that it can come into contact with the ink in the replenishing ink cartridge.

As means for setting the ink holding force d of the capillary tubes of the relay core and the ink holding force D of the capillary tubes of the porous body or fiber bundle serving as the ink absorber to satisfy:

$$d<D$$

the difference in material between the relay core and the ink absorber (the difference in wettability for ink depending on the material) can be utilized. It is also effective to set a difference in porosity or percentage of void (or large and small of porosity or percentage of void) between the respective materials. If these two means are utilized, a replenishing ink cartridge optimum for the printing ink cartridge that performs replenishment can be obtained.

Concerning the material of the relay core, the relay core may be made of a fiber bundle, a resin porous body having open cells, or the like.

Regarding a color-printing ink cartridge having a plurality of ink storage chambers, it can be replenished with a plurality of color ink in optimum amounts at once by replenishing ink cartridges divided into a plurality of ink storage chambers in units of colors.

As an ink cartridge to which these ink replenishing methods can be applied, one formed with an opening portion through which a relay core for supplying a replenishing ink can come into contact with an ink absorber and having a hole through which air can be replaced is preferable, e.g., one having an ink discharge port (printing head) and an atmosphere communicating port (air exchange hole), one having an opening portion and an atmosphere communicating port that can come into contact with the ink relay portion (not shown) of a separate ink discharging portion (not shown), and the like, because when performing air exchange during ink replenishment to the printing ink cartridge, the ink charging rate is not decreased.

Furthermore, an air exchange portion must be formed in the replenishing ink cartridge so that, along with ink replenishment, air can flow into the replenishing ink cartridge. To form the air exchange portion, for example, an air hole may be formed in the replenishing ink cartridge. Alternatively, the shape of the relay core insertion port of the replenishing ink cartridge and the outer shape of the relay core may be made different, and the gap between them may be used as the air exchange hole.

The relay core can be made detachable from the replenishing ink cartridge. An ink in the replenishing ink cartridge is not completely consumed, but in ink replenishment, the remaining ink can be kept for next ink replenishment. After the relay core is removed, the relay core insertion port of the replenishing ink cartridge is capped to be able to prevent volatility weight loss of the ink. As the temperature or atmospheric pressure changes during storage or transportation, air in the replenishing ink cartridge may be expanded and the ink may thus be injected from the relay core and the atmospheric communicating port. However, with the means described above, these problems can be avoided.

The relay core which is used once has been soaked with the ink. When the relay core in this state is used again, it is dry while containing the ink. Then, the capillary action may be changed so that sometimes the ink charging rate may be decreased or the ink cannot flow through the relay core. Thus, when reusing the replenishing ink cartridge which has been stored, it is desirable to use it after inserting a new relay core in its relay core insertion port.

To form a gap portion near the relay core, a space is formed in the tube body in which the relay core is to be inserted. As means for forming the space in the tube body, two tubular or cylindrical members having different diameters are fitted with each other, and the small-diameter tubular member is partly notched, thereby easily forming a space in the tube body.

To form the gap portion near the relay core, alternatively, a groove portion may be formed in the relay core itself.

With an ink replenishing apparatus according to the present invention, when replenishing a printing ink cartridge, which has an ink absorber made of a porous body or fiber bundle in an ink storage chamber that stores ink, with ink supplied from a replenishing ink cartridge through a relay core, an ink holding force d1 of the capillary tubes of the relay core, an holding force d2 generated between the relay core and the replenishing ink cartridge, and an ink holding force D of the capillary tubes of the porous body or fiber bundle can be set to satisfy:

$$d1+d2<D$$

The larger the difference D−(d1+d2) is, the more the time required for replenishing the ink absorber in the printing ink cartridge with the same amount of ink can be shortened.

To make d2 small, a gap portion may be formed near the relay core, which is one of the effective and reliable means.

Concerning the material of the relay core to be used, the relay core may be made of a fiber bundle, a resin porous body having open cells, or the like.

If the relay core is used alone, its position cannot be fixed between the replenishing ink cartridge and the printing ink cartridge, or it may soil a portion around it with ink because the ink is exposed from the relay core to the outside. Therefore, a relay core-holding portion need be formed in the replenishing ink cartridge so that the relay core can be held, and an unnecessary portion thereof need be isolated from the outside. As a result, a contact portion inevitably exists between the relay core and the holding portion, and the ink holding force d2 is also inevitably generated at this contact portion.

In order to decrease the ink holding force d2 at this contact portion, a gap portion is formed near the relay core. To decrease the contact area between the relay core and the holding portion, a space is formed in the tube body in which the relay core is to be inserted. To form the space in the tube body, two tubular or cylindrical members having different diameters are fitted with each other, and the small-diameter tubular member is partly notched, thereby easily forming a space in the tube body.

To form the gap portion near the relay core, alternatively, a groove portion may be formed in the relay core itself.

In the present invention, the relay core is inserted in the replenishing ink cartridge so that it can come into contact with ink in the replenishing ink cartridge.

Other than forming a gap portion near the relay core, as means for setting the ink holding force d1 of the capillary tubes of the relay core, the holding force d2 generated between the relay core and the holding portion of the replenishing ink cartridge, and the ink holding force D of the capillary tubes of the porous body or fiber bundle serving as the ink absorber to satisfy:

$$d1+d2<D$$

the difference in material between the relay core and the ink absorber (the difference in wettability for ink depending on the material) can be utilized in order to make d1 small. It is also effective to set a difference in porosity or percentage of void (or large and small of porosity or percentage of void) between the respective materials. If these two means are utilized, a larger effect can be achieved.

The ink replenishing method for the printing ink cartridge according to the present invention is achieved by inclining the interior of the ink storage chamber such that the head pressure acting on the opening portion of the printing ink cartridge is smaller than that in the vertical state.

In the present invention, the relay core is inserted in the replenishing ink cartridge so that it can come into contact with the ink in the replenishing ink cartridge.

The ink holding force d of the capillary tubes of the relay core and the ink holding force D of the capillary tubes of the porous body or fiber bundle serving as the ink absorber must satisfy:

$$d<D$$

For this purpose, the difference in material between the relay core and the ink absorber (the difference in wettability for ink depending on the material) can be utilized. It is also effective to set a difference in porosity or percentage of void (or large and small of porosity or percentage of void) between the respective materials. If these two means are utilized, an ink replenishing method for a printing ink cartridge can be provided.

To incline the interior of the ink storage chamber from the vertical position at which the opening portion of the printing ink cartridge faces downward, keeping the printing ink cartridge inclined can be achieved most easily by using a jig or the like.

Preferred embodiments of the present invention will be described with reference to the accompanying drawings. In the preferred embodiments, the ink absorber of the printing ink cartridge is made of a porous body having open cells, and the ink holding force of the capillary tubes of the relay core is maintained by adjusting the percentage of void of the fiber bundle. However, the present invention is not limited to the following preferred embodiments, as a matter of course.

Figure 2:
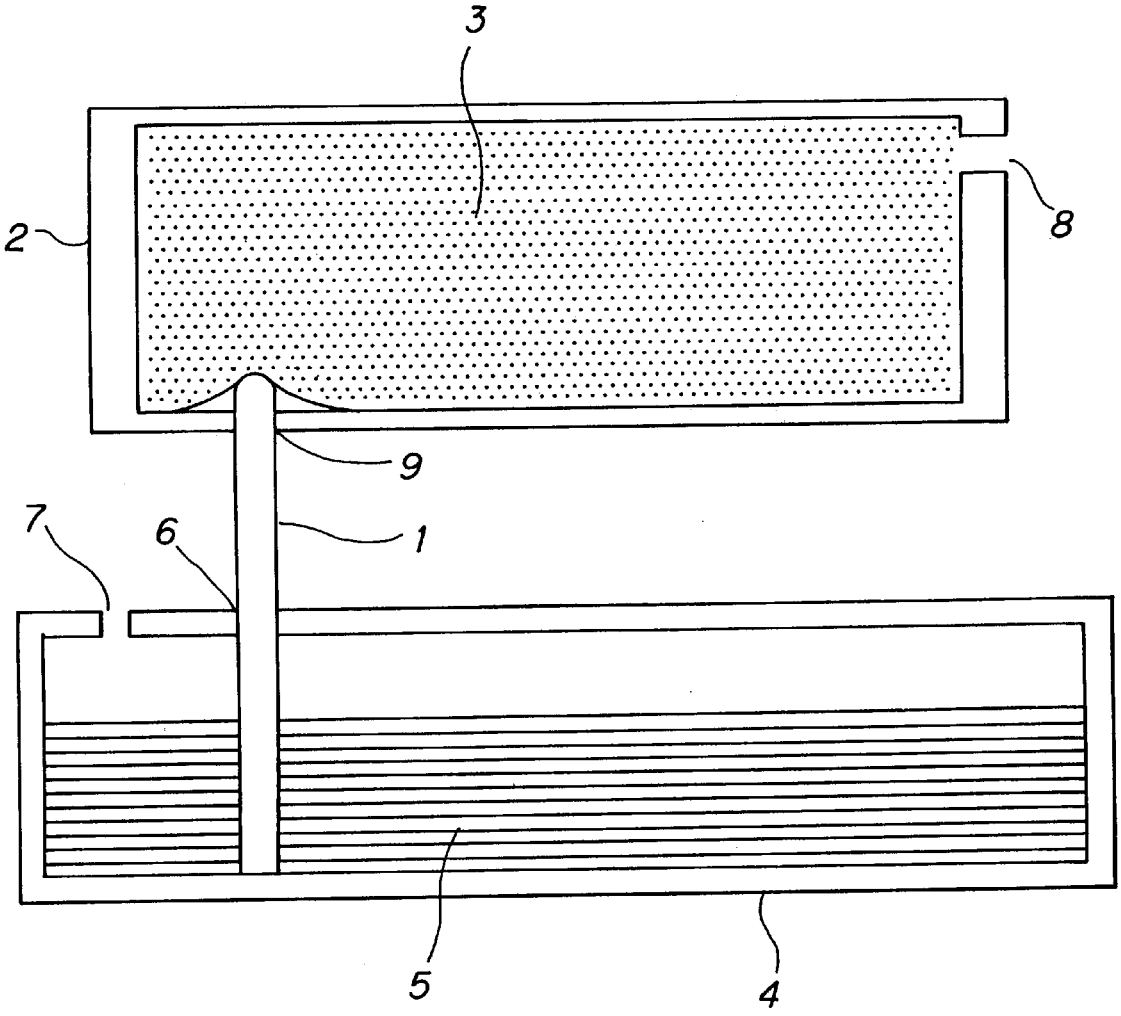
FIG. 2 is a longitudinal sectional view of the ink replenishing apparatus shown in FIG. 1.

FIGS. 1 and 2 show the first embodiment of the present invention.

Referring to FIGS. 1 and 2, an ink absorber 3 is stored in a printing ink cartridge 2, and a relay core 1 extending from a replenishing ink cartridge 4 is inserted in an opening portion 9 that can come into contact with the ink relay portion (not shown) of an ink discharge portion (not shown). The relay core 1 comes into contact with the ink absorber 3. The relay core 1 is made of a fiber bundle having a larger percentage of void than that of the ink absorber 3. Ink 5 in the replenishing ink cartridge 4 which is sucked up by the capillary action of the relay core 1 is absorbed by the ink absorber 3.

The printing ink cartridge 2 and the replenishing ink cartridge 4 are respectively formed with atmosphere communicating ports 8 and 7.

Figure 3:
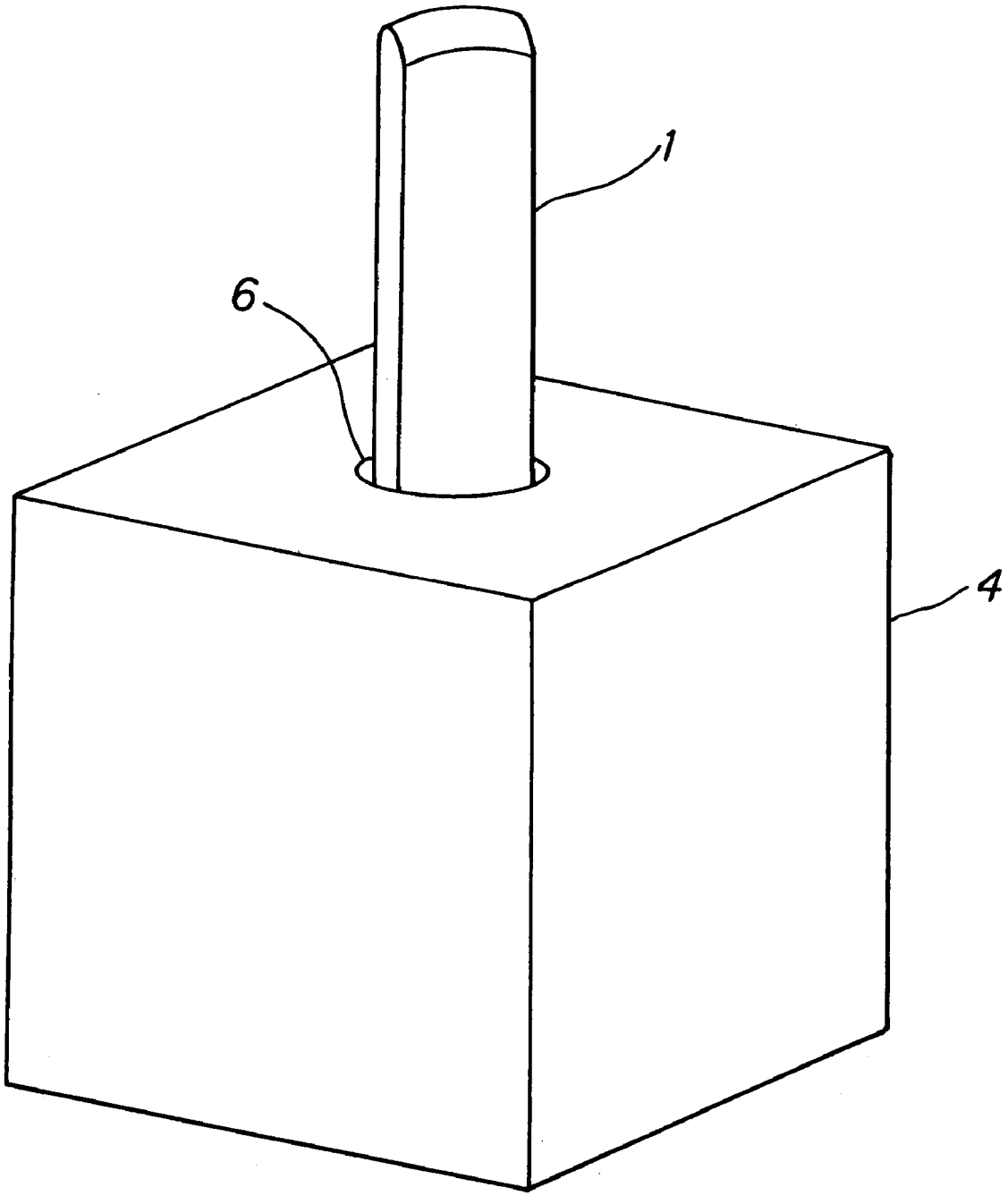
FIG. 3 is a perspective view showing an ink replenishing apparatus according to the second embodiment of the present invention.

The second embodiment of the present invention shown in FIG. 3 shows a replenishing ink cartridge having no atmosphere communicating port. A relay core 1 has a square section, and a relay core hole 6 is circular. The gap between the relay core 1 and the relay core hole 6 serves as the atmosphere communicating port.

Figure 4:
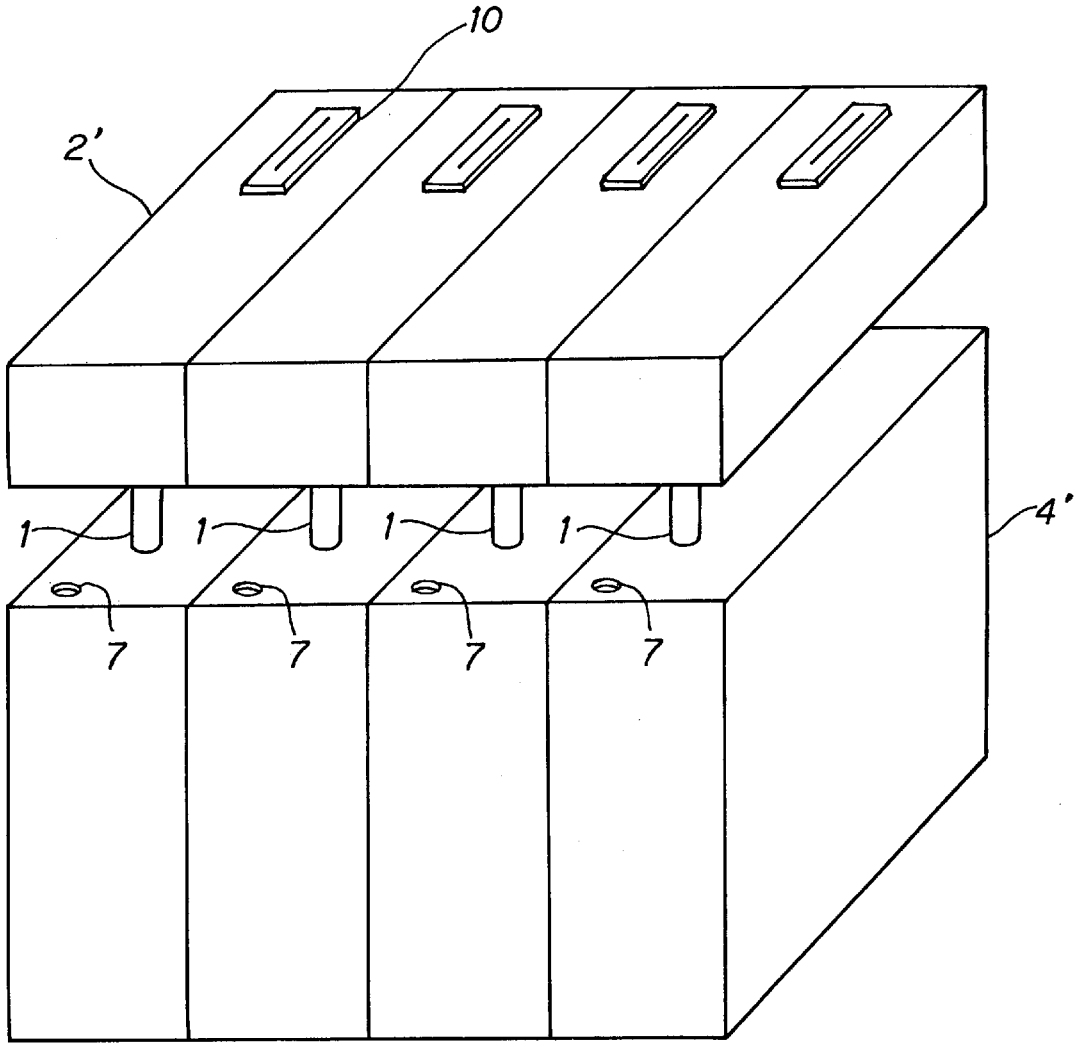
FIG. 4 is a perspective view showing an ink replenishing apparatus according to the third embodiment of the present invention, which indicates a state wherein an ink-jet printing ink cartridge having a plurality of ink storage chambers is being replenished with ink by using the ink replenishing apparatus according to the present invention.

FIG. 4 showing the third embodiment of the present invention indicates a case wherein an ink cartridge 2' used in color printing is to be replenished with ink.

The ink cartridge 2' is divided into a plurality of ink storage chambers. A replenishing ink cartridge 4' is similarly divided into a plurality of ink storage chambers in units of colors to correspond to the plurality of ink storage chambers of the ink cartridge 2', and has a plurality of relay cores 1.

Figure 5:
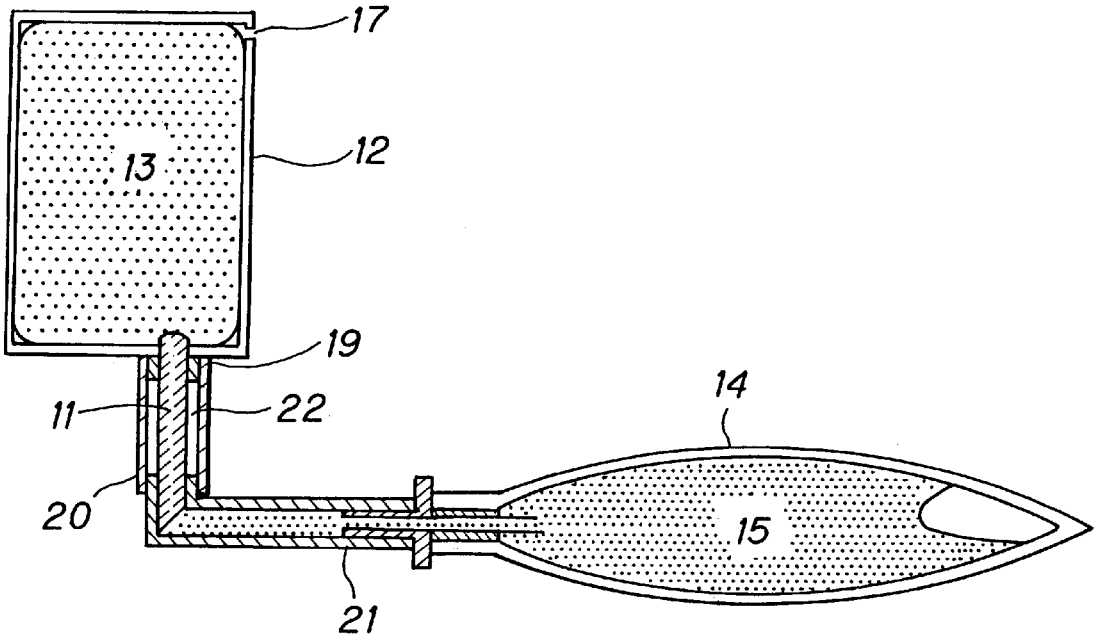
FIG. 5 is a longitudinal sectional view showing an ink replenishing apparatus according to the fourth embodiment of the present invention, which indicates an ink replenishing state.

FIG. 5 is a schematic sectional view showing the fourth embodiment of the present invention.

An ink absorber 13 is stored in a printing ink cartridge 12, and a relay core 11 extending from a bag-like replenishing ink cartridge 14 is inserted in an opening portion 19 that can come into contact with the ink relay portion (not shown) of an ink discharge portion (not shown). Therefore, the relay core 11 comes into contact with the ink absorber 13.

The relay core 11 is inserted in an ink introducing tube 21. The ink introducing tube 21 is inserted in a relay core holder 20 and is formed with notches 22.

The relay core 11 is made of a fiber bundle having a larger percentage of void than that of the ink absorber 13. Ink 15 in the replenishing ink cartridge 14 which is sucked up by the capillary action of the relay core 11 is absorbed by the ink absorber 13.

The printing ink cartridge 12 is formed with an atmosphere communicating port 17.

Figure 6:
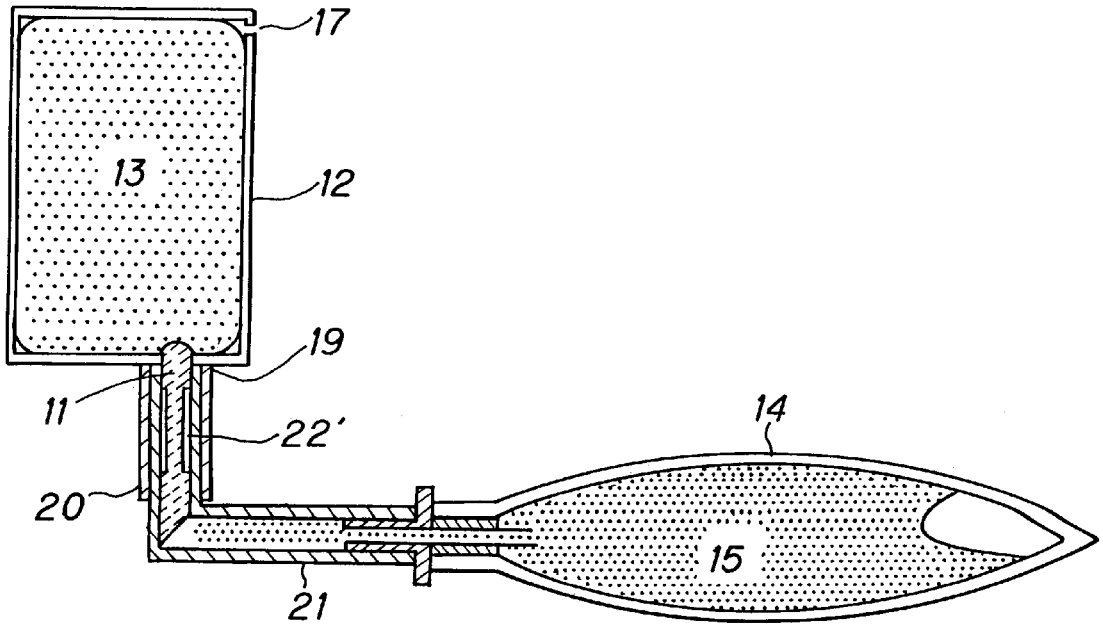
FIG. 6 is a longitudinal sectional view showing an ink replenishing apparatus according to the fifth embodiment of the present invention, which indicates an ink replenishing state.

FIG. 6 is a schematic sectional view showing the fifth embodiment of the present invention.

In the fifth embodiment, in setting a gap portion near the relay core, grooves 22' are formed in a relay core 11 in place of the notches 22 in the ink introducing tube 21 of the fourth embodiment.

The replenishing ink cartridge used in this embodiment is constituted by a flexible bag made of laminated films interposed with an aluminum foil, and is constricted along with ink replenishment.

If air is charged in 3 to 30% in the replenishing ink cartridge together with ink, the ink in the replenishing ink cartridge can be completely charged in the printing ink cartridge.

Figure 7:
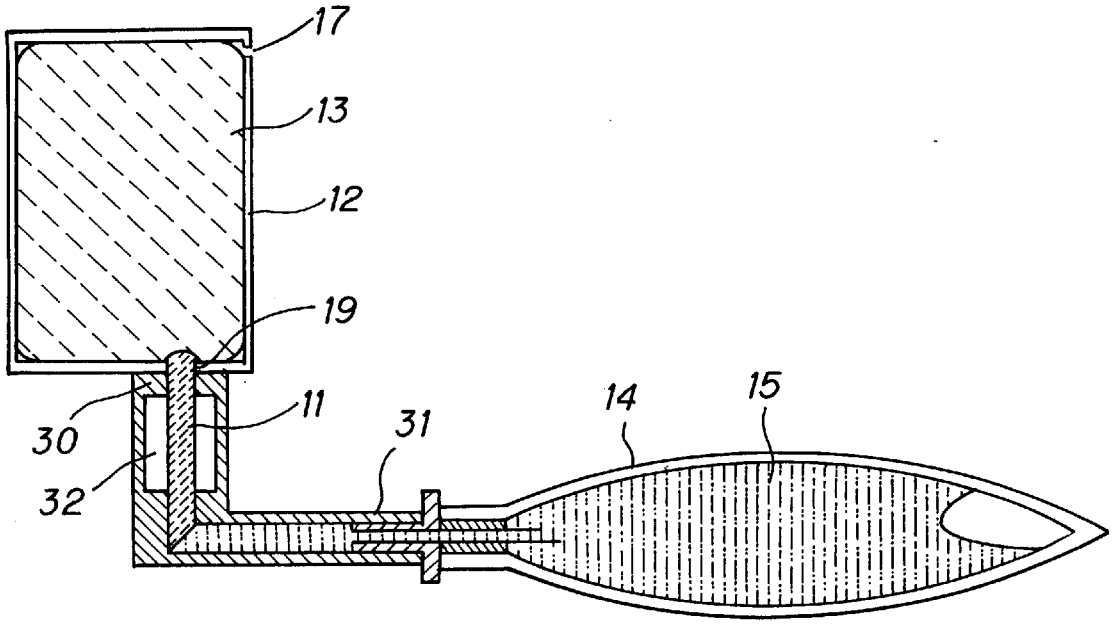
FIG. 7 is a longitudinal sectional view showing an ink replenishing apparatus according to the sixth embodiment of the present invention, which indicates an ink replenishing state.

FIG. 7 is a schematic sectional view showing the sixth embodiment of the present invention.

The sixth embodiment is different from the fourth embodiment of FIG. 5 in that a relay core 11 is inserted in a holding portion 30 formed at the distal end of an ink introducing tube 31 and that notches 32 are formed in the holding portion 30.

Figure 8:
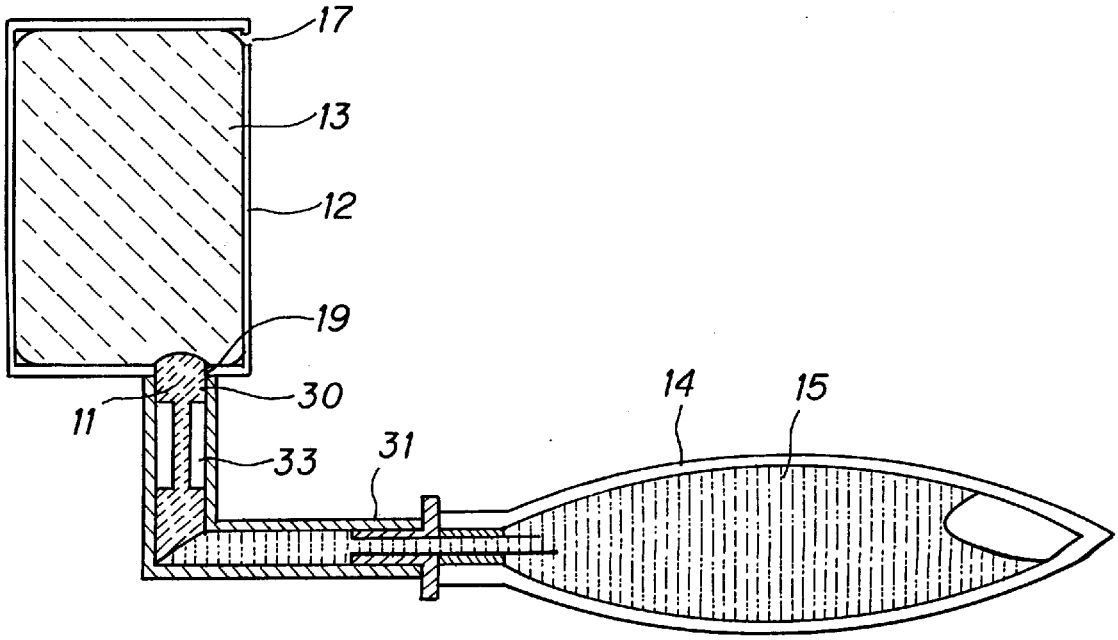
FIG. 8 is a longitudinal sectional view showing an ink replenishing apparatus according to the seventh embodiment of the present invention, which indicates an ink replenishing state.

FIG. 8 is a schematic sectional view showing the seventh embodiment of the present invention.

This embodiment is obtained by forming, in setting a gap portion around the relay core, grooves 33 in a relay core 11 in place of the notches 32 in the holding portion 30 of the sixth embodiment.

Figure 9:
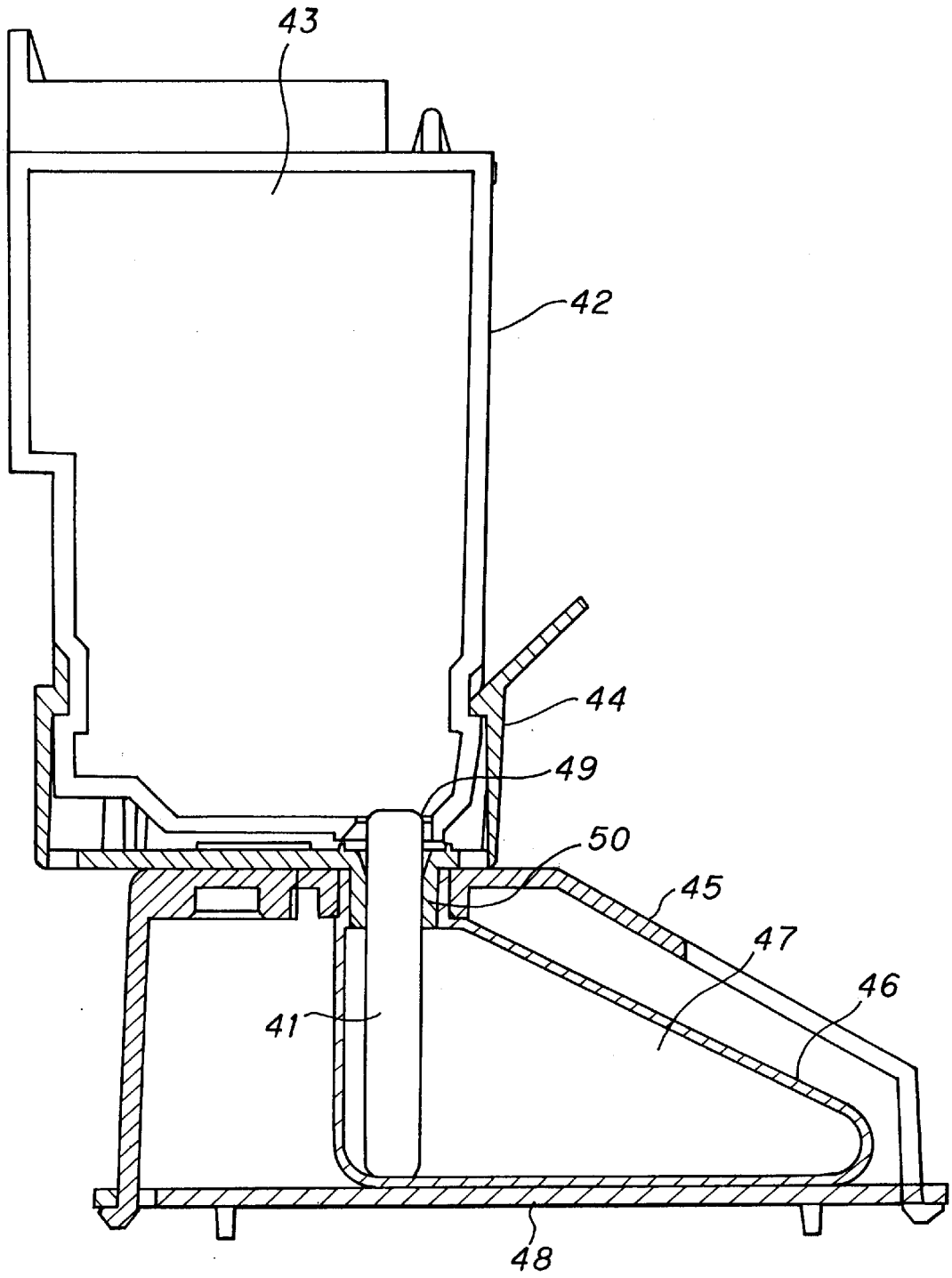
FIG. 9 is a longitudinal sectional view showing an ink replenishing apparatus according to the eighth embodiment of the present invention.
Figure 10:
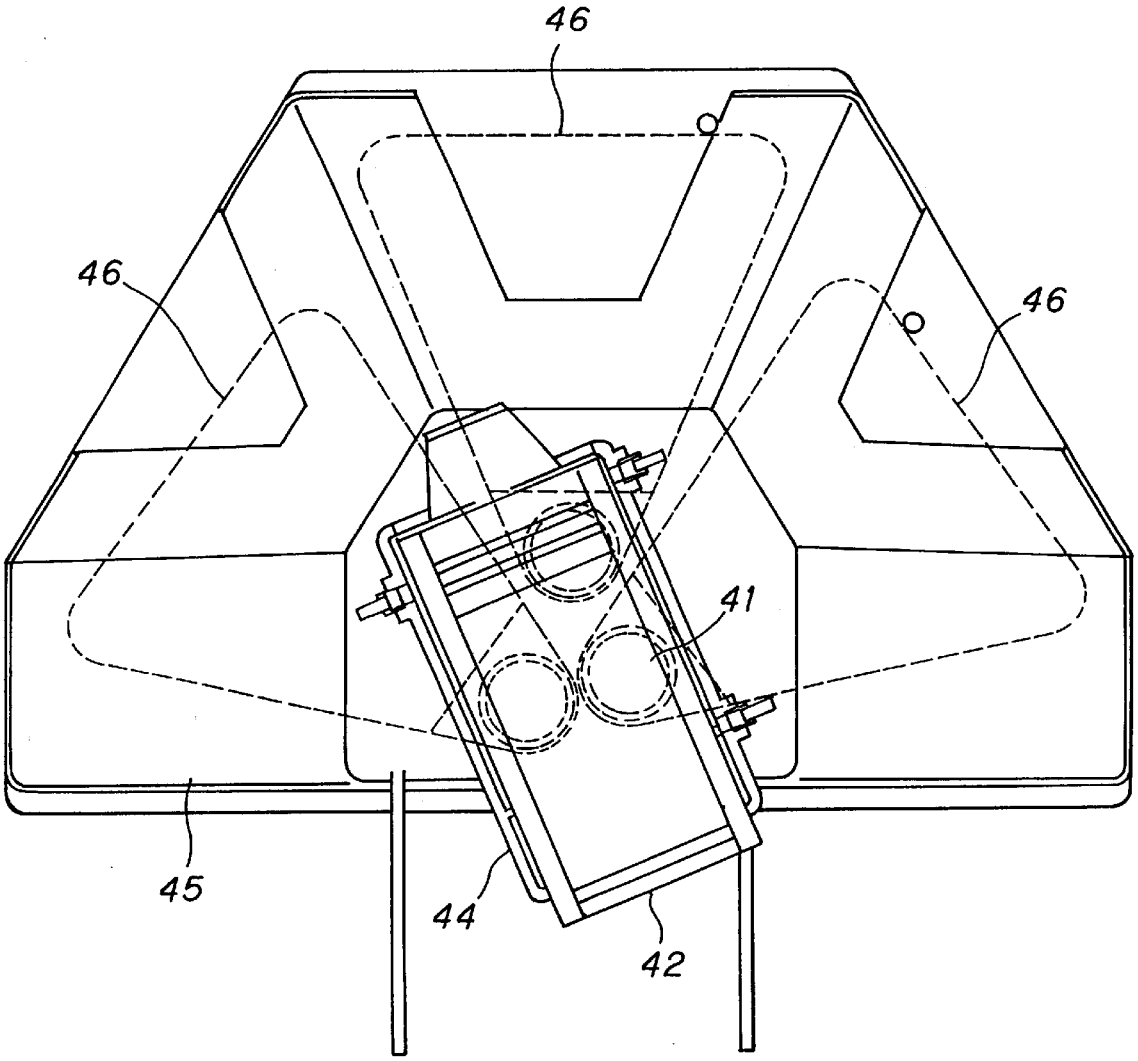
FIG. 10 is a plan view of the ink replenishing apparatus shown in FIG. 9.

FIG. 9 shows the eighth embodiment of the present invention, and FIG. 10 is a plan view of FIG. 9. As shown in FIGS. 9 and 10, an ink absorber 43 is stored in a printing ink cartridge 42, and the ink absorber 43 is made of a porous body having open cells. An opening portion 49 that can come into contact with the ink relay portion (not shown) of an ink discharge portion (not shown) is formed in the bottom surface of the printing ink cartridge 42. A relay core 41 extending from a triangular-pyramidal replenishing ink cartridge 46 is inserted in the opening portion 49 to come into contact with the ink absorber 43. The ink holding force of the capillary tubes of the relay core 41 is maintained by adjusting the percentage of void of the fiber bundle. Ink 47 in the replenishing ink cartridge 46 which is sucked up by the capillary tubes of the relay core 41 is absorbed by the ink absorber 43.

Figure 11:
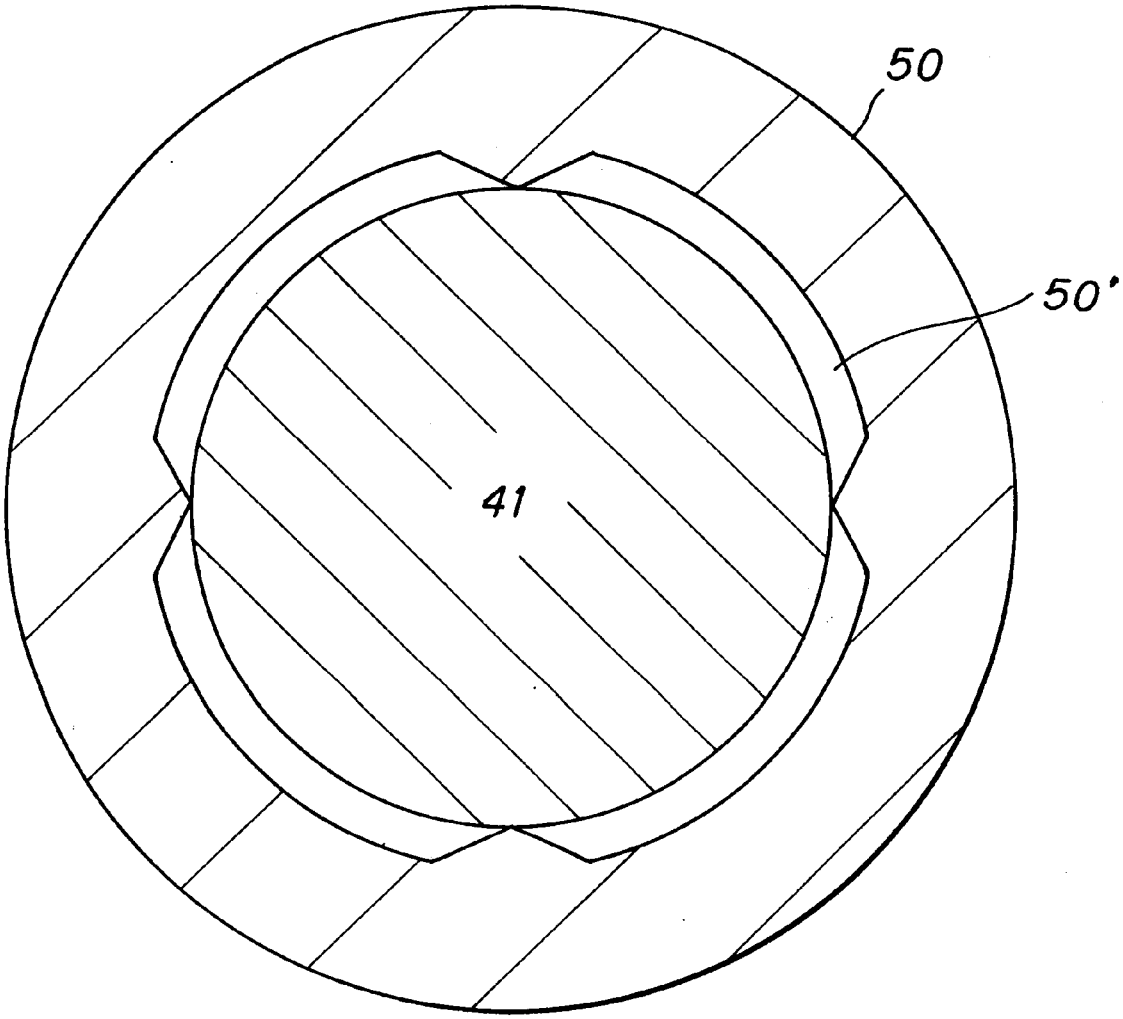
FIG. 11 is a cross-sectional view showing a relationship between the relay core and the holding portion.

The relay core 41 is inserted in a holding portion 50 extending from a cartridge holder 44. The holding portion 50 is formed with notches 50' (see FIG. 11) for exchanging air in the replenishing ink cartridge 46. The replenishing ink cartridge 46 is accommodated and fixed in a space formed by a cover 45 and a base 48. The cartridge holder 44 is supported and fixed on the cover 45. The printing ink cartridge 42 is mounted in the cartridge holder 44. The relay core 41 comes into contact with the ink absorber 43 through the opening portion 49.

Figure 12:
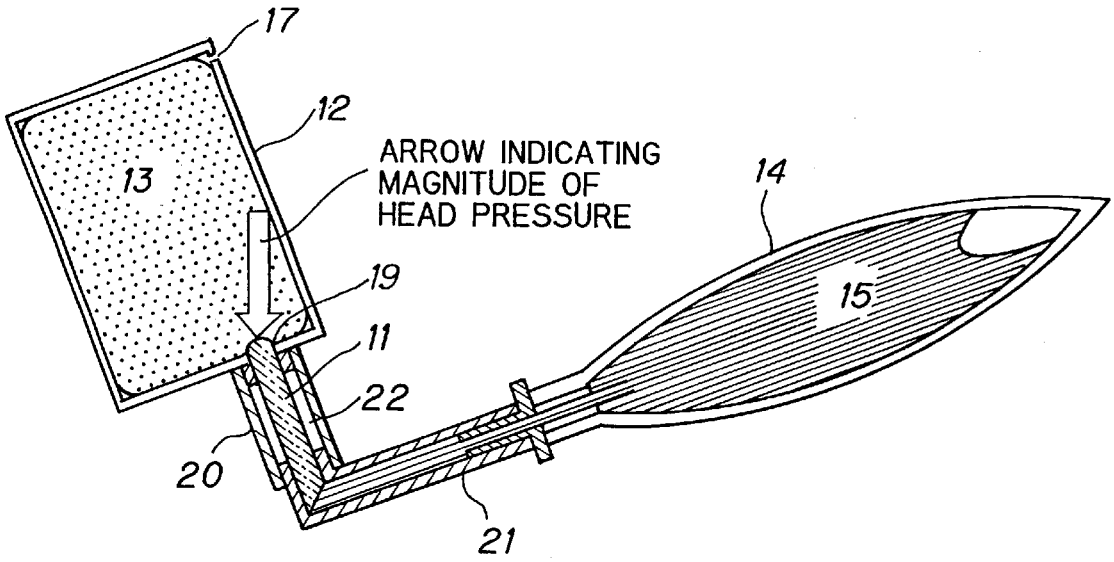
FIG. 12 is a longitudinal sectional view showing a state wherein the ink-jet printing ink cartridge is being replenished with ink by using the ink replenishing apparatus shown in FIG. 5.
Figure 13:
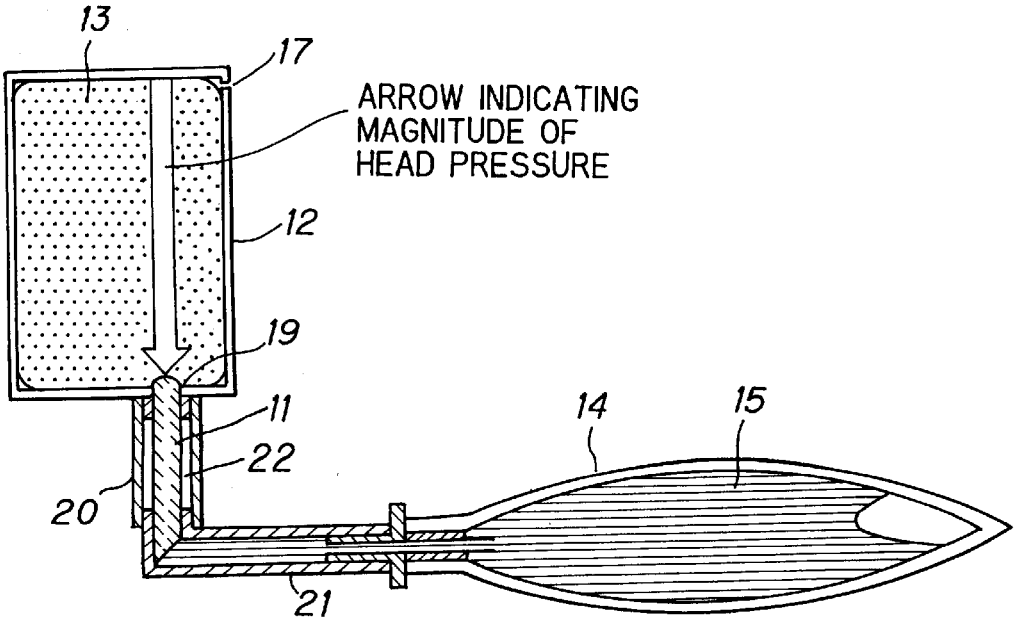
FIG. 13 is a longitudinal sectional view showing a comparative example against the ink replenishing method shown in FIG. 12.

FIG. 12 is a schematic sectional view showing an ink replenishing method employing the ink replenishing apparatus shown in FIG. 5, and FIG. 13 is a schematic sectional view showing a comparative example.

The ink storage chamber is inclined as shown in FIG. 12 such that the head pressure acting on the opening portion 19 of the ink cartridge 12 becomes smaller than that in the vertical state. Then, as indicated by arrows in the figures, the head pressure acting on the opening portion 19 can be decreased to be lower than that in the comparative example shown in FIG. 13. As a result, the ink supply rate can be increased accordingly by a value corresponding to the decrease in head pressure.

Figure 14:
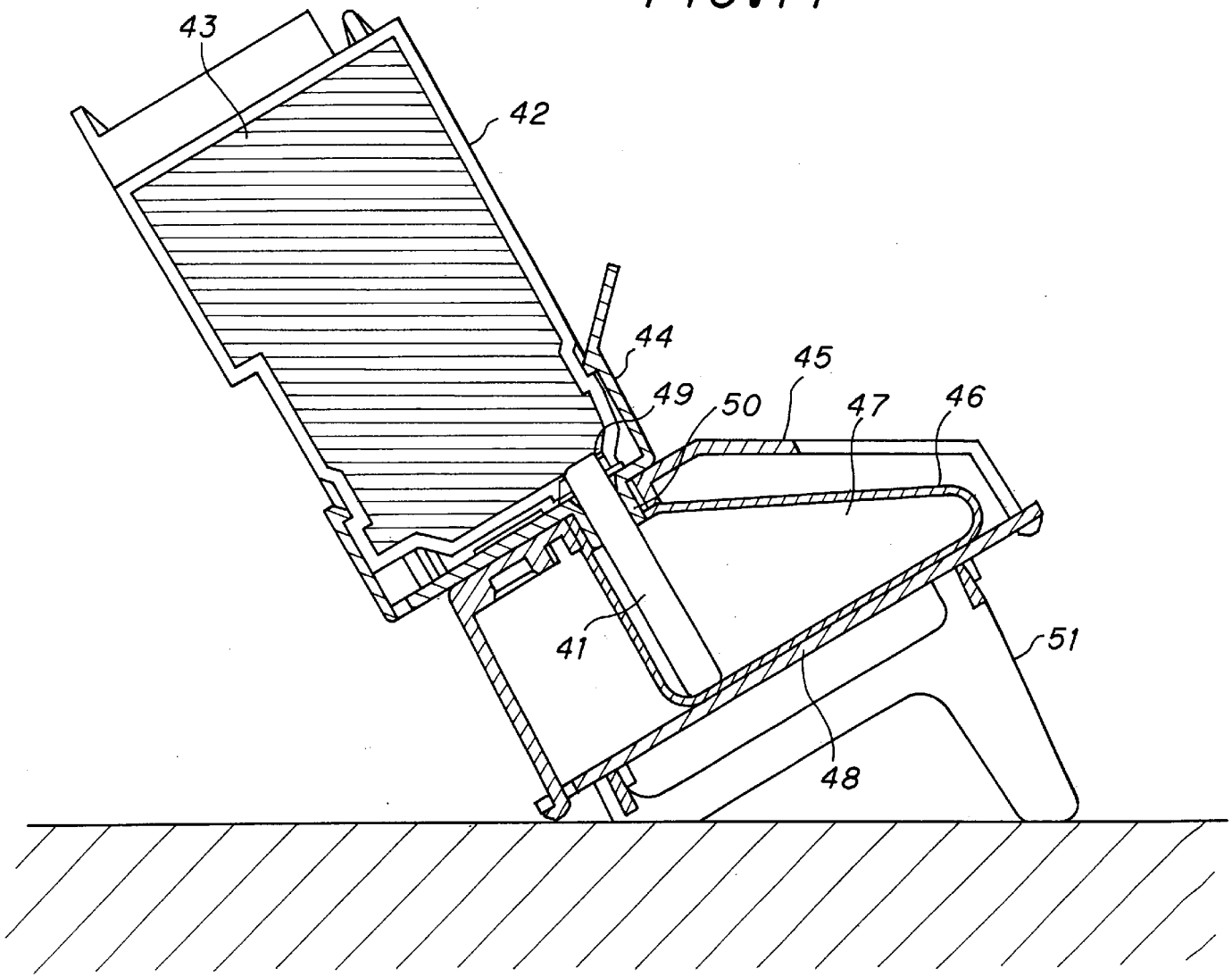
FIG. 14 is a longitudinal sectional view showing a state wherein the ink-jet printing ink cartridge is being replenished with ink by using the ink replenishing apparatus shown in FIG. 9.

FIG. 14 is a schematic sectional view showing another ink replenishing method employing the ink replenishing apparatus shown in FIG. 9. As is apparent from FIG. 14, a support 51 for inclining the ink storage chamber by a certain angle with respect to the installation surface is mounted on the lower portion of the base 48. Hence, the head pressure of the ink absorbed by the ink absorber 43 in the printing ink cartridge 42 acts on the ink 47 in the replenishing ink cartridge 46 smaller than that in the vertical state, i.e., the head pressure of the ink absorbed by the ink absorber 43 to act on the relay core 41 can be decreased. The ink supply rate can be increased accordingly by a value corresponding to the decrease in head pressure.

As has been described above in detail, according to the ink replenishing apparatus of the present invention, when replenishing the printing ink cartridge, which has the ink absorber made of the porous body or fiber bundle in the ink storage chamber, with ink, it will not be replenished with the ink excessively, and can be replenished with the optimum amount of ink to be replenished in accordance with the amount of ink remaining in the printing ink cartridge.

Since the ink holding force of the capillary tubes of the relay core is smaller than that of the ink absorber, ink which has replenished the printing ink cartridge once will not flow backward to the replenishing ink cartridge.

Regarding a color-printing ink cartridge usually having a plurality of ink storage chambers in units of colors, optimum amounts of ink can be supplied to the ink storage chambers very easily in accordance with the remaining ink amounts in the respective ink storage chambers.

If a vent hole is not formed in the replenishing ink cartridge and the relay core hole is covered with a sealing plug, the volatility weight loss of the ink can be prevented even if the replenishing ink cartridge is stored over a long period of time. In this case, if the relay core and the relay core hole have different shapes, air exchange can be enabled through the gap formed between them.

With this replenishing ink cartridge, ink replenishment of even the ink storage portion of an ink ribbon cassette can be performed.

If the relay core is held by the relay core holder and the ink introducing tube, a gap is formed between them, and air (not shown) in the relay core which is pushed out by the ink flow is released into this gap, then the ink flow will not be hindered by small air bubbles in the relay core.

Alternatively, if the relay core is held by the holding portion, and a gap is formed between the relay core and the holding portion to decrease an ink holding force generated between them, a factor that increases the time required for ink replenishment of the ink absorber can be eliminated.

What is claimed is:

1. An apparatus for replenishing a color ink-jet printing cartridge with ink of a plurality of colors, the apparatus comprising:

the color ink-jet printing cartridge having a plurality of ink storage chambers, each storage chamber containing an ink absorber, the ink absorber having a capillary ink holding force D;

a color ink cartridge having at least one wall defining a plurality of replenishing ink storage chambers adapted to hold replenishing ink of a plurality of colors; and a plurality of relay cores, each relay core including a plurality of capillary tubes having a capillary ink holding force d, the relay core having a first end connected to a respective replenishing ink storage chamber and a second end adapted to connect to the ink-jet printing cartridge such that the plurality of capillary tubes provide fluid communication between the respective replenishing ink storage chamber of the ink cartridge and the ink absorber in the respective ink storage chamber of the printing cartridge;

wherein the capillary ink holding force d is less than the capillary ink holding force D.

2. The apparatus according to claim 1, wherein said at least one wall of said ink cartridge has a plurality of openings proximal to said respective relay cores.

3. An apparatus for replenishing a color ink-jet printing cartridge with ink of a plurality of colors, the apparatus comprising:

the color ink-jet printing cartridge having a plurality of ink storage chambers, each storage chamber containing an ink absorber, the ink absorber having a capillary ink holding force D;

a color ink cartridge having at least one wall defining a plurality of replenishing ink storage chambers adapted to hold replenishing ink of a plurality of colors; and a plurality of relay cores, each relay core including a plurality of capillary tubes having a capillary ink holding force d1, the relay core having a first end connected to a respective replenishing ink storage chamber and a second end adapted to connect to the ink-jet printing cartridge such that the plurality of capillary tubes provide fluid communication between the respective replenishing ink storage chamber of the ink cartridge and the ink absorber of the respective ink storage chamber of the printing cartridge;

wherein an ink holding force d2 which exists between the respective relay core and a holding portion of a respective replenishing ink storage chamber combined with the capillary ink holding force d1 is less than the capillary ink holding force D.

4. The apparatus according to claim 3, wherein said at least one wall of said ink cartridge has a plurality of openings proximal to said respective relay cores in order to decrease the ink holding force d2 between said relay cores and said holding portions of said respective replenishing ink storage chambers of said ink cartridge.

5. A method for replenishing a color ink-jet printing cartridge with ink of a plurality of colors, comprising the steps of:

providing the color ink-jet printing cartridge having a plurality of ink storage chambers, each chamber with a replenishing opening, each ink storage chamber containing an ink absorber having a capillary ink holding force D;

providing a plurality of relay cores, each relay core including a plurality of capillary tubes having a capillary ink holding force d;

connecting a first end of each respective relay core to a respective replenishing ink storage chamber of an ink cartridge having a quantity of replenishing ink;

connecting a second end of each respective relay core to a respective ink storage chamber of the printing cartridge through the respective replenishing opening such that the plurality of capillary tubes provides fluid communication between the respective replenishing ink storage chamber of the ink cartridge and the ink absorber in the respective ink storage chamber of the printing cartridge wherein the capillary ink holding force d is less than the capillary ink holding force D; and inclining the ink storage chambers of the printing cartridge from a vertical orientation to an angle relative to said vertical orientation such that a head pressure acting on the replenishing openings is less than that in said vertical orientation.

* * * * *